United States Patent [19]

Sullivan

[11] Patent Number: 4,852,072

[45] Date of Patent: Jul. 25, 1989

[54] CLOCK APPARATUS

[76] Inventor: Scott L. Sullivan, 3 Garden Ridge, Chappaqua, N.Y. 10514

[21] Appl. No.: 226,235

[22] Filed: Jul. 29, 1988

[51] Int. Cl.[4] ..... G04B 19/04

[52] U.S. Cl. ..... 368/238; 368/228

[58] Field of Search ..... 368/238, 228, 229

[56] References Cited

U.S. PATENT DOCUMENTS

| | | | |
|---|---|---|---|
| 3,952,500 | 4/1976 | Tomura | 368/238 |
| 4,127,928 | 12/1978 | Green | 368/238 |
| 4,583,864 | 4/1986 | Graves | 368/229 |

FOREIGN PATENT DOCUMENTS

| | | | |
|---|---|---|---|
| 363695 | 11/1922 | Fed. Rep. of Germany | 368/238 |
| 155165 | 9/1932 | Switzerland | 368/228 |

*Primary Examiner*—Bernard Roskoski

[57] ABSTRACT

An analog clock is provided having three hands for indicating hours, minutes, and seconds. An hours hand is positioned in a conventional manner, rotating at an hours rate around a central point. A minutes hand is located at any satellite point along the hours hand except the central point and rotates about this satellite point at a minutes rate. A seconds hand is located anywhere along either the minutes hand or the hours hand and rotates at a seconds rate.

17 Claims, 6 Drawing Sheets

(12:15 27 sec.)

(12:15 27sec.)

(4:58 45sec.)

(9:30 38sec.)

(3:00 12sec.)

CLOCK APPARATUS

FIELD OF THE INVENTION

This invention relates to a novel clock apparatus, and more particularly, to an analog clock whereby the three conventional time indicating hands (hours, minutes, and seconds) rotate around three separate axes and provide an indication of time. The present invention is intended to provide an analog clock for indicating time of day (T.O.D.) in hours, minutes, and seconds in such a manner that an aesthetically interesting shape which is defined by the novel arrangement of the hands, continually changes with time, and provides a kinetic time-indicating sculpture.

BACKGROUND OF THE INVENTION

Time indicating sculptures exist where different shapes are created as the hands of an analog clock rotate and indicate time. U.S. Pat. No. 3,952,500 issued to Temura discloses such an ornamental time piece. In U.S. Pat. No. 3,952,500, two hand-like members, identical in length to the hours hand and the minutes hand, respectively, are pivotally connected to each other and the ends of conventional hours and minutes hands. With this arrangement, a parallelogram shape is created and as the clocking hands rotate with time, the parallelogram changes shape. The hours and minutes clocking hands of U.S. Pat. No. 3,952,500 rotate around the same central point as provided by a conventional clocking mechanism.

SUMMARY OF THE INVENTION

An analog clock includes a first time indicating member rotatable about a first point at a first rate and a second time indicating member which is rotatable about a second point at a second rate. The second point is located anywhere along the first time indicating member except at the first point.

DESCRIPTION OF THE PREFERRED EMBODIMENT

Figure 1:
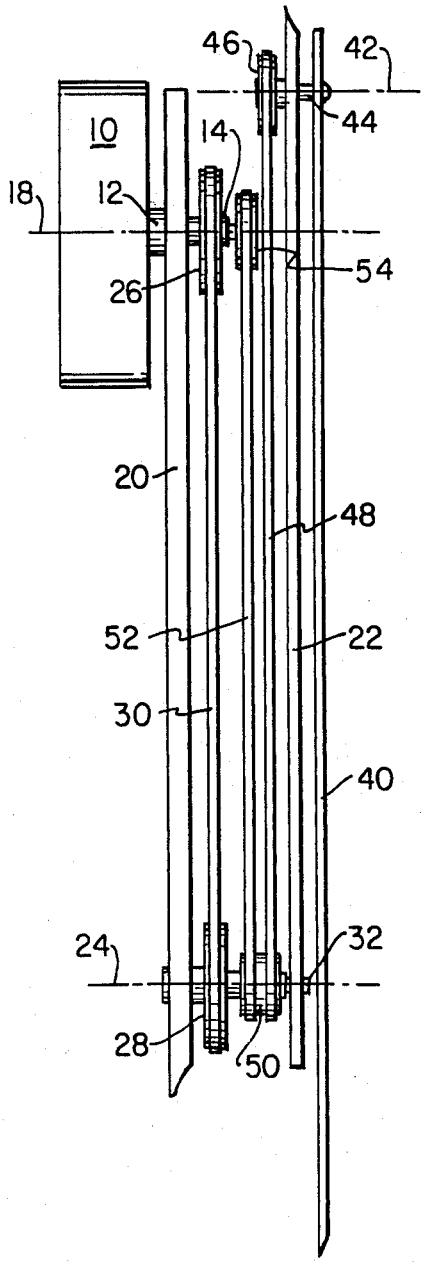
FIG. 1 is an overall side view of the hand assembly of the present invention showing the relative positions of three clocking hands and driving belts.
Figure 2:
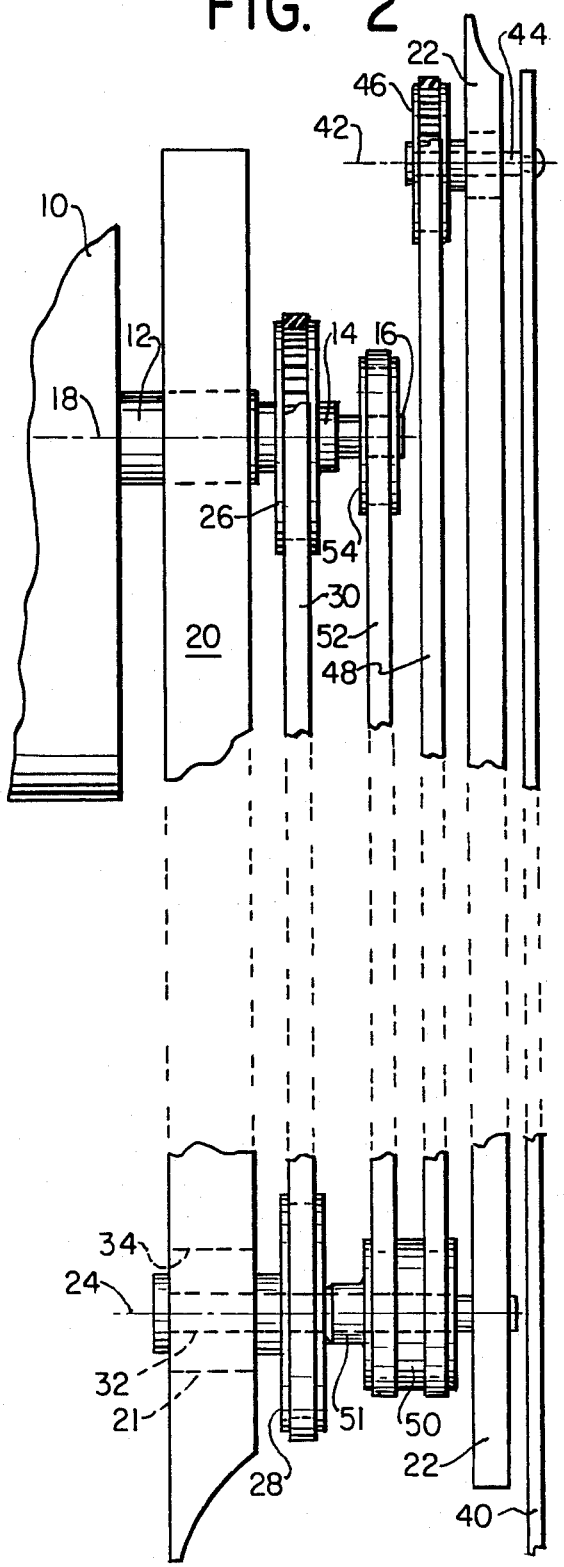
FIG. 2 is an enlarged view of FIG. 1, showing details of the driving belts and satellite pulleys.

The present invention provides a clock comprising a clock mechanism 10. This may be any conventional clock mechanism which provides at least two output drive shafts, an hours shaft 12 rotating at an hours rate (1/720 RPM) and a minutes shaft 14 rotating at a minutes rate (1/60 RPM), but preferably also including a seconds shaft 16 rotating at a seconds rate (1 RPM). Typically, clock mechanisms include their output drive shafts in a telescoping arrangement, wherein the seconds shaft 16 rotates independently within the minutes shaft 14, which, in turn, rotates independently within the hours shaft 12, all three shafts rotating around a single central axis 18. The preferred embodiment utilizes a clock mechanism having the three output shafts (hours, minutes, and seconds) in such a telescoping arrangement. FIGS. 1 and 2 show the three output shafts following this telescoping arrangement.

An hours hand 20 is fixed to the hours shaft 12 such that it rotates with the hours shaft 12 as the hours shaft 12 is driven at the hours rate. The hours hand 20 rotates in a plane which is perpendicular to the central axis 18, in a conventional manner. The preferred hours hand is 10 inches long and is made of a rigid, lightweight material such as thermoplastic. The length and material of each hand can vary depending on the size and appearance of the clock intended and the type of clock mechanism used. Other suitable materials for the hands include aluminum, wood, acrylic plastics, and brass. It is desirable in this preferred embodiment to keep all the hands described as light as structurally possible. The output hours shaft 12 must have sufficient torque to rotate such an hours hand 20, and a minutes and seconds hand as described further below.

A minutes hand 22 is rotatably attached to the hours hand 20 at any point therealong, except at the location of the central axis 18, thereby differing from the conventional analog hand arrangement. The minutes hand 22 rotates around this point in a plane which is both parallel to the plane wherein the hours hand 20 rotates and perpendicular to a first satellite axis 24. The first satellite axis 24 is located at the point along the hours hand 20 where the minutes hand 22 is attached. The first satellite axis 24 is therefore parallel to the central axis 18 and is the axis about which the minutes hand 22 rotates.

The minutes hand 22 is longer than the hours hand 20 such that it is distinguishably different from the hours hand 20. The preferred length for the minutes hand 22 is 12 inches. The minutes hand 22 is also preferably made from a light weight thermoplastic to minimize the amount of torque required by the hours shaft 12, owing to the added weight of the hours hand 20 due to the attached minutes hand 22.

Figure 9:
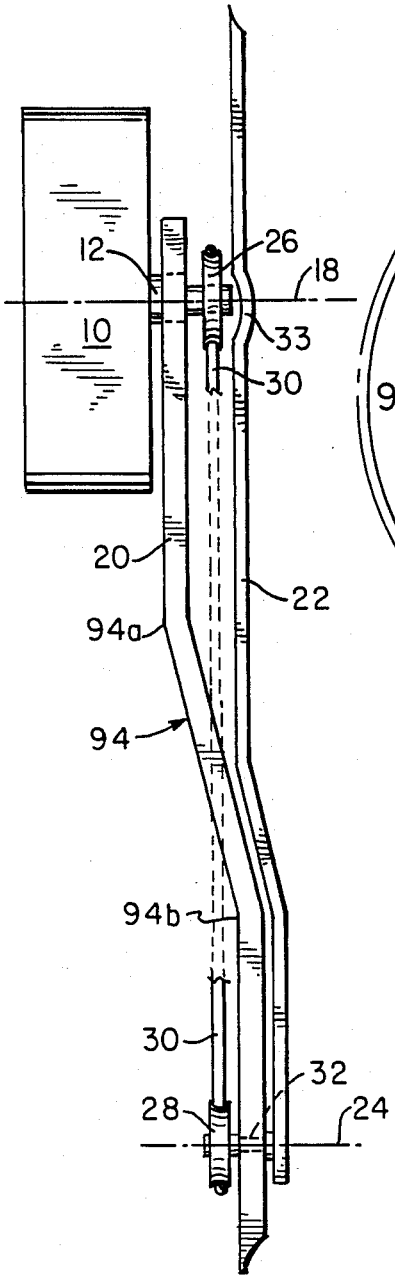
FIG. 9 is a side view of one embodiment of the present invention showing a bent hours hand and minutes hand.

The minutes hand 22 is driven around the first satellite axis 24 at the prescribed minutes rate. This is accomplished in the preferred embodiment by a central pulley 26, a first satellite pulley 28, a minutes drive belt 30 and a first satellite axle 32. The first satellite axle 32 is fixed to the minutes hand 22 such that it is aligned with the first satellite axis 24. The hours hand 20 has a hole 34 disposed therethrough at the predetermined point where the minutes hand 22 is meant to rotate about the hours hand 20. The hole 34 receives the first satellite axle 32 and permits the rotation of the minutes hand 22 around this prescribed point. Depending on the material of the hours hand 20, a bushing 21 (or a bearing) may be used to create a pivoting surface for the first satellite axle 32 to rotate which provides less friction than provided by the material of the hours hand alone. The hole may be used alone when the hours hand material is brass, aluminum (or other metal) or a hard plastic. An indent 33, shown in FIG. 9 is provided at a point along the minutes hand 22 (depending on its length and relative position with the hours hand 20) so that in operation, the indent aligns with the central output drive shafts of the clock mechanism (axis 18) when the minutes hand 22 rotates past it. This allows the minutes hand 22 to rotate in a plane which is closer to the hours hand 20. Thus, the clock can be kept thin without problems relating to the minutes hand 22 hitting the output drive shafts.

The minutes drive belt hereinafter described is preferably a rubber belt with engagement teeth to prevent slipping. These toothed belts can be purchased from Winfred M. Berg, Inc. of East Rockaway, N.Y. as part No. TB7EF2-150 for a ⅛th inch wide belt having a pitch length of 12 inches long. The corresponding pulleys with matching engagement teeth are Berg's Part No. TP7E2U4-10. Alternatives of using the toothed belts are O ring type belts, or thread tied into a endless belt and looped around each engaging pulley several times to develop a non-slip grip. Also, a link chain and corresponding sprockets can be used; Berg's Part Nos. RC14SS-80 (approximately 12 inches long) and 14EM1-0A-21, respectively. The seconds drive belt is preferably made from thread or string because the seconds hand, described below, requires little torque to rotate, relative to the other hands.

The central pulley 26 is fixed to the minutes output shaft 14 of the clock mechanism 10 so that it rotates with the output shaft 14 at the prescribed minutes rate. The first satellite pulley 28 is attached to the first satellite axle 32 so that the first satellite axle 32 and the attached minutes hand 22 rotate with the first satellite pulley 28. The first satellite pulley 28 and the central pulley 26 follow in a plane which is parallel to the hours hand 20. When the minutes drive belt 30 is positioned around both the first satellite pulley 28 and the central pulley 26, it transmits the rotational torque of the central pulley 26 to the first satellite pulley 28 as the central pulley turns. The first satellite pulley 28, in turn, rotates the minutes hand 22 around the first satellite axis 24. The first satellite pulley 28 and the central pulley 26 have the same diameter so that they both rotate at the same rate and in the same direction. The minutes hand 22 is therefore driven around the prescribed point of the hours hand 20 at the independent minutes rate and in the conventional clockwise direction while the hours hand 20 rotates around the central axis 18 at the hours rate and in a conventional clockwise direction.

Since the minutes hand 22 and the hours hand 20 rotate at conventional minutes and hours rate, respectively, then time measured by the relative position between the hands is kept conventional. The present clock is read keeping in mind that the twelve o'clock position remains in the conventional location, the upper most position of the circle inscribed by the pointing end of the hours hand 20. Similarly, the 0 or 60 minutes position remains in the conventional location with respect to the point around which the minute hand 22 rotates. Although, this minutes hand 22 rotates around a point which is different from conventional analog clock design (where all hands rotate around a common central point), the 0 or 60 minutes position is still the upper most location of the circle inscribed by the pointing end of the rotating minutes hand 22. Comparative examples between a conventional analog clock and the present analog clock invention are shown in FIGS. **4*a*–4*f***.

A seconds hand 40 is preferably attached to the minutes hand 22, at any point along the minutes hand including the location of the satellite axis 24, but can also be located along the hours hand without departing from the present invention. The seconds hand 40 is made from a very light material such as thin aluminum, wood, or plastic and is preferably 14 inches long so that it is distinguishable from the other two hands. However, the seconds hand 40 can also be a much shorter length such as 4 inches (also being distinguishable from the other hands). Since, the seconds hand in this preferred embodiment does not support any additional hands, it can and should be very light in weight and delicate looking (very thin). A very light seconds hand is desirable so that the amount of torque required to rotate it around the second satellite axis 42 is minimized.

The seconds hand 40 rotates around a second satellite axis 42 at a seconds rate of rotation, one rotation every minute. The seconds hand 40 is fixed to a second satellite axle 44 using a set screw, adhesive or other functionally similar methods. In this preferred embodiment, the second satellite axle 44 is pivotally attached to the minutes hand 22, aligning with the second satellite axis 42 and providing support for the seconds hand 40 to rotate. A second satellite pulley 46 is fixed to the second satellite axle 44 such that its rotation causes simultaneous rotation of the seconds hand 40. The second satellite pulley 46 is rotated by a pulley belt 48. This pulley belt 48 is located around the second satellite pulley 46 and around an elbow pulley 50. The elbow pulley 50 has two grooves (it can be made from two separate pulleys secured together), one to accept the pulley belt 48 and the other to accept a seconds driving pulley belt 52. The two grooves of the elbow pulley 50 are located in two planes that are parallel to all three of the clock hands 20, 22, and 40, and align with the second satellite pulley 46 and a central seconds drive pulley 54 (further described below). The elbow pulley 50 sits above the minutes hand surface, around the first satellite axle 32 and is free to rotate therearound, independent from the rotation of the minutes pulley 22. In the preferred embodiment the elbow pulley 50 is attached to an axle sleeve which creates a bushing around the first satellite axle 32. The central seconds drive pulley 54 is fixed to the central seconds output shaft 16 and rotates with the shaft at the seconds rate. The seconds rate of the central drive pulley 54 is transmitted via the seconds driving pulley belt 52 to rotate the elbow pulley 50. The rotating elbow pulley 50 moves the pulley belt 48 so that the second satellite pulley 46 rotates at the seconds rate and in the same direction as the central seconds output shaft 16.

Figure 3:
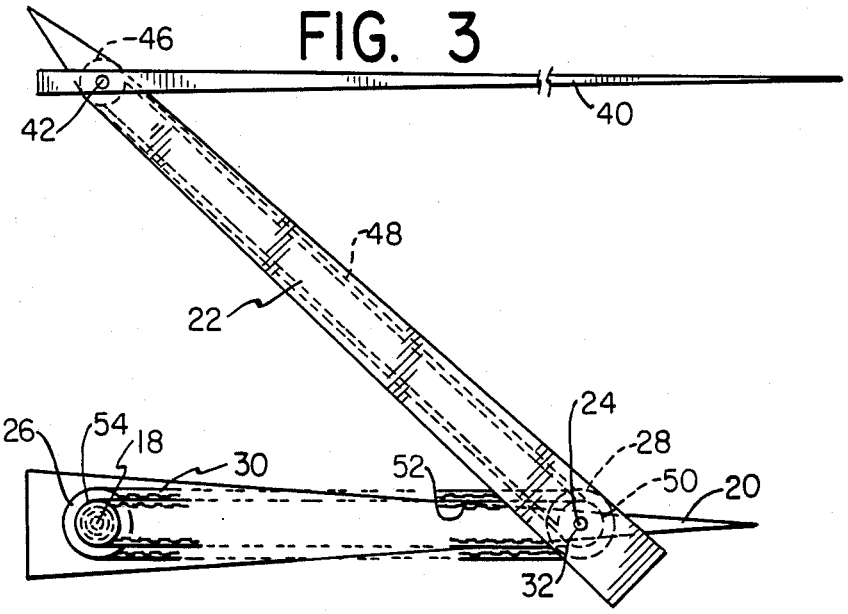
FIG. 3 is an overall top view of the clock of the present invention showing the three clocking hands, the driving belts and satellite pulleys.
Figure 4A:
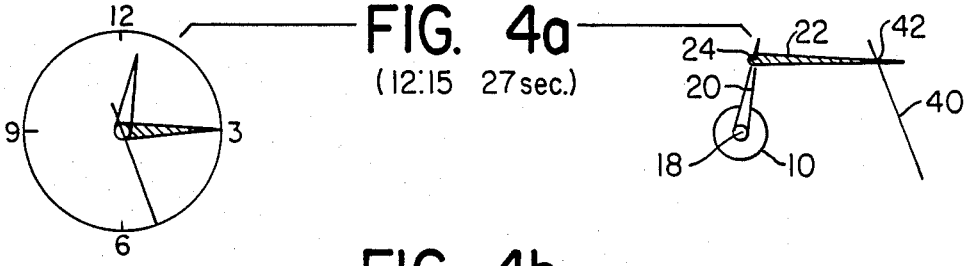
FIG. 4*a*–FIG. 4*d* are examples of time measurement showing comparisons between the conventional analog and digital clock arrangements and the clock arrangement of the present invention.
Figure 4B:
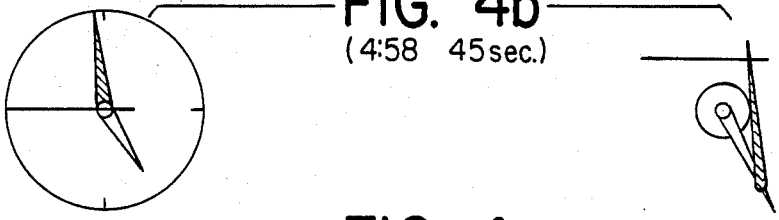
Figure 4C:
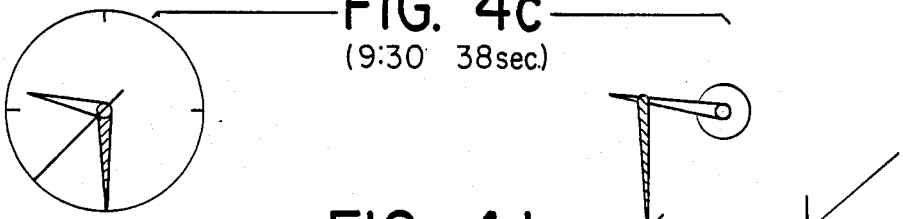
Figure 4D:
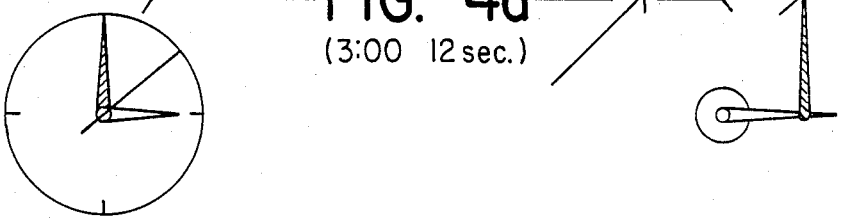
Figure 8:
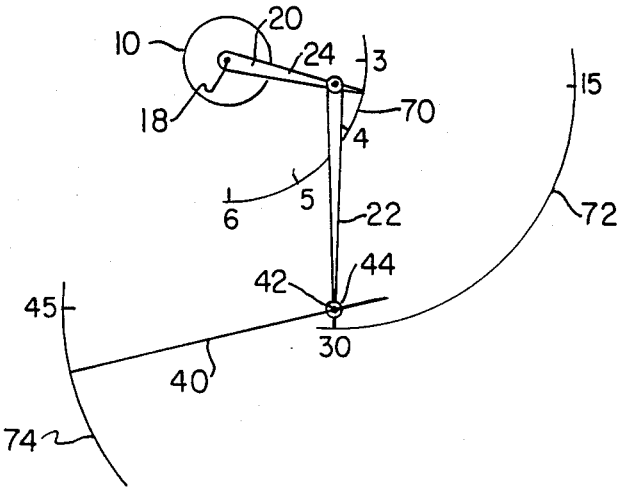
FIG. 8 is a front view schematic of a clock showing the hand arrangement of the present invention including segments of the reference rings.

The preferred clock of the present invention therefore has a conventionally located hours hand, a minutes hand which rotates around a point located preferably near the end of the hours hand and a seconds hand which rotates around a point located near the end of the minutes hand, as shown in FIG. 3 and FIG. 8.

The clock mechanism 10 rotates the three output clock shafts; hours 12, minutes 14, and seconds 16 at their respective rates with sufficient torque to enable the hours hand 20, the minutes hand 22, and the seconds hand 40 to rotate about their axes 18, 24, and 42, respectively.

Figure 11:
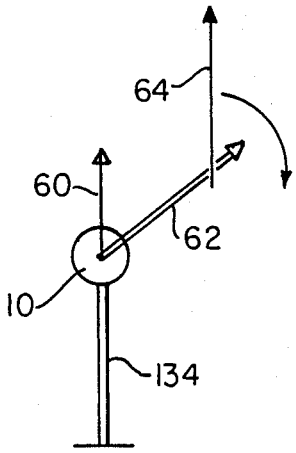
FIG. 11 is an overall front view of another embodiment of the present invention showing a seconds hand located on the minutes hand.
Figure 12:
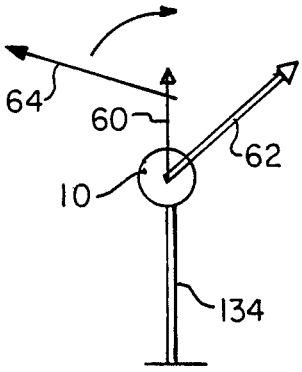
FIG. 12 is an overall front view of another embodiment of the present invention showing the seconds hand located on the hours hand.

A second embodiment of the present invention is shown in FIGS. 11 and 12. In FIG. 11, an hours hand 60 and a minutes hand 62 are shown in a conventional manner having a seconds hand 64 which is located at a point along the minutes hand 62. FIG. 12 shows a similar conventional hand arrangement, but the seconds hand 64 is located at a point along the hours hand 60. The seconds hand 64 rotates around either point (hours hand or minutes hand) using a similar technique used and described above in the preferred embodiment, to rotate the minutes hand 22 around a point along the hours hand 20.

Figure 5:
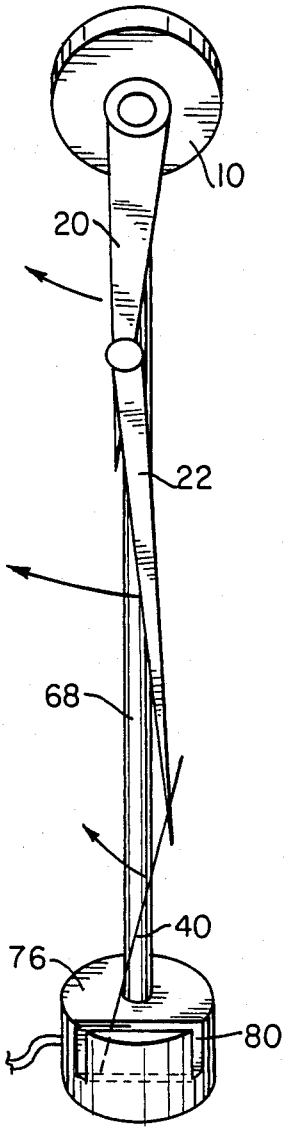
FIG. 5 is a front view of a clock of the present invention showing the clocking hands, a stand, and a base.

In any arrangement of clock hands using the concept of the present invention whereby at least one hand rotates around a point along a second hand which is different from the driving point of that second hand (usually the center of a conventional clock), the hands will at some point during their rotation extend further from the center point then a conventional clock. In other words, it is likely that at least one hand will extend beyond the face of a conventional clock. This extension of the hands should not cause a problem for clocks intended to be hung on a wall. However, in the preferred embodiment, the clock is intended to be mounted on top of a stand 68 supported by a base 76 resting on a table or the floor, as shown in FIG. 5. The height of the stand and base must provide sufficient clearance to allow the extended hand or hands to swing past the base, as further described below.

The clock arrangement using the concept of the present invention can be incorporated with any analog clock including a wall clock, a floor clock, a clock for indicating elapsed time having addition hands extended from the above mentioned seconds hand to indicate tenths of a second, etc, and a watch.

Figure 7:
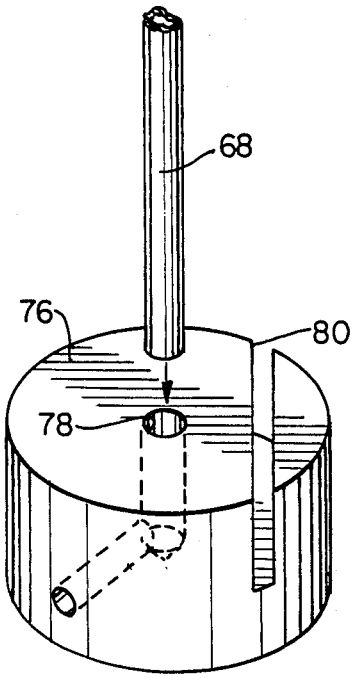
FIG. 7 is a perspective view showing details of the base of one embodiment of the present invention.

The clock of the preferred embodiment does not have a face. Time is read by relative positions of the three hands within each imaginary inscribed reference circle. The hours reference circle 70 is in the conventional location, the minutes reference circle 72 is centered around its rotating point along the hours hand 20 and the seconds reference circle 74 is centered around its rotating point along the minutes hand 22. The preferred clock is fixed to a tubular stand 68 which can be any supportive material such as polished brass or aluminum, or wood. A power cord for the clocking mechanism can be hidden within the hollow stand if an external power supply is required. The stand 68 is held upright by the base 76 which is made from a aesthetically pleasing material depending on the material used for the other clock parts such as wood, brass, steel, aluminum or other. The base 76 is preferably a cylindrically shaped piece of heavy steel. A hole 78 for receiving one end of the tubular stand 68 is provided through the top of the base and out through one side. The power cord can be elbowed through the top of the base so that it leaves through the side and does not disturb the level standing of the clock. The tubular stand 68 can be secured into the hole 78 of the base 76 using any convention method such as a force-fit, welding, or adhesive. The preferred base also includes a slot 80 positioned down from the top surface of the base, parallel to the tubular stand 68 as shown in FIGS. 5 and 7 and in line with the seconds hand 40. The preferred length of the tubular stand 68 is such that the hand arrangement when fully extended downward (at six thirty and thirty seconds), the end of the seconds hand will swing into the slot 80 provided in the base 76. The purpose for having the seconds hand 40 swing through the slot 80 is primarily to provide an interesting clock, but also allows the clock have long hands yet remain at a closer and more stable height from the base 76.

Figure 6:
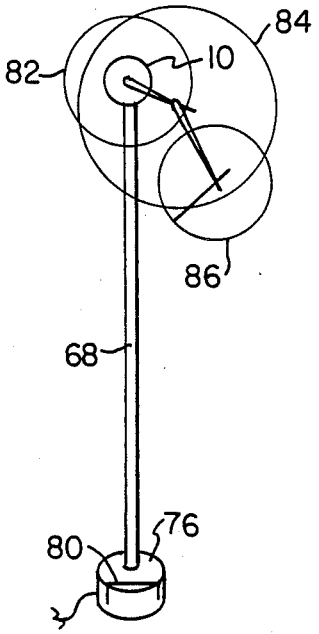
FIG. 6 is a front view of a clock of the present invention showing three reference rings.
Figure 13A:
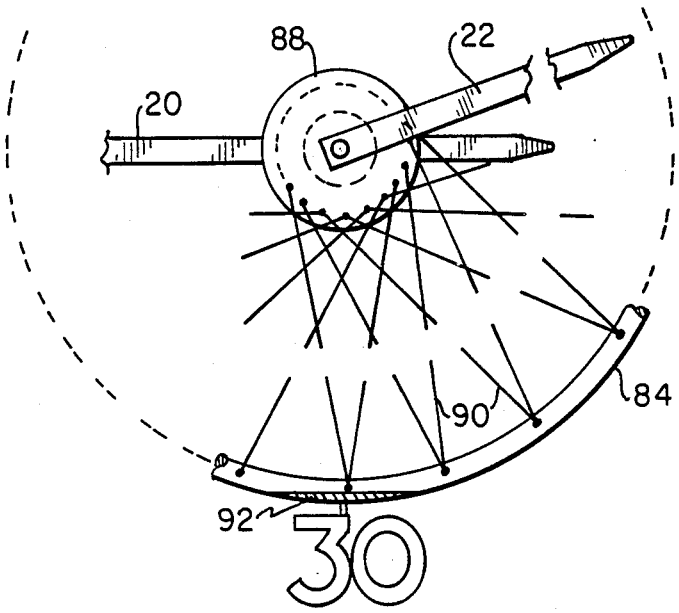
FIG. 13*a* is a front partial view of another embodiment of the present invention showing details of a minutes reference ring.
Figure 13B:
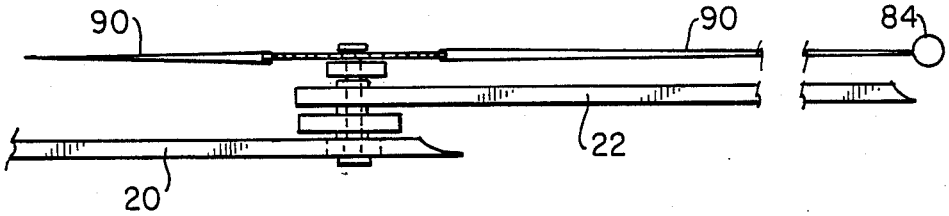
FIG. 13*b* is a side view of FIG. 13*a*.

FIG. 6 shows another embodiment of the present invention where the reference circles 70, 72, and 74 for the hours hand 20, the minutes hand 22, and the seconds hand 40, respectively, are provided by three metal reference rings 82, 84, and 86, for each respective hand 20, 22, and 40. The hours reference ring 82 has a radius which is close (slightly greater) to the length of the hours hand 20 (ten inches). The minutes and seconds reference rings, 84, and 86, have respective radii which depend on the length of the minutes hand 22 and the seconds hand 40, and where each is located along the hours hand 20 and the minutes hand, respectively. All three reference rings 82, 84, and 86, are preferably made of any light, rigid material such as thermoplastic, wood, or aluminum. The minutes and seconds reference ring 84, 86 each have a central hub 88 which holds its ring by either several thin spokes 90 made of similar light material or a taut fine string such as thread, or one sturdy spoke which is gradually curved like an "S" so that it is distinguishable from the hands of the clock. The hub 88 and spokes 90 are shown in FIG. 13*a* for the minutes hand reference ring 86. The hours reference ring 82 can be attached to the tubular stand 68 in the 6 o'clock position. The other two reference rings 84, 86 are pivotally attached to the first satellite 32 and the second satellite 44, respectively. Each satellite axle 32, 44 in this embodiment includes a space for the hub 88 of the minutes and seconds reference ring 84, 86 to rotate. This space is shown for the minutes reference ring 84 located on the first satellite 32 in FIG. 13*b*. In this embodiment involving reference rings, it is necessary to use a seconds hand which (if a seconds reference ring 86 is used) is shorter in length than the minutes hand so that the seconds reference ring 86 does not interfere with the rotation of the minutes hand 22.

Each reference ring 82, 84, and 86 includes numerical indicia along its circumference which corresponds to unit values typical to each hand. For example, the numbers "12", "3", "6", and "9", arranged in the conventional manner can be used for the hours reference ring 82; the numbers "60" or "0", "15", "30", and "45" conventionally positioned can be used for the minutes and seconds reference rings 84, 86. The hours reference ring 82 will always remain stationary with respect to the tubular stand 68 and is similar and analogous to a conventional clock face indicia. However, the minutes and seconds reference rings 84, 86 are rotatable and therefore are weighted with weight 92 located at the "30" (minute or second) position so that they will always keep a consistent reference. Specifically, the number indicia will remain in the conventional position regardless of where the hours hand 20 is positioning the first satellite 32 or similarly, where the minutes hand 22 is positioning the second satellite 44. This is shown in FIG. 13. The three clock hands indicate time by pointing to an independent relative position along their respective reference ring which is always kept in the conventional position.

FIG. 9 shows yet another embodiment of the present invention where the hours hand 20 has a bend 94 located between the first satellite axis 24 and the central axis 18. The bend 94 is such that an outer plane is defined by the flat portion of the hours hand 20 at the location of the first satellite axis 24. This outer plane is parallel to an inner plane defined by the flat portion of the hours hand 20 at the location of the central axis 18. The plane through which the minutes drive belt 30 is located is between the inner plane and the outer plane, as shown in FIG. 9. The first satellite pulley 28 is relocated from the above described preferred embodiment from the front (viewing side) of the minutes hand 22 to behind the minutes hand 22 keeping everything else the same. The central pulley 26 used to drive the minutes hand 22 around the first satellite axle 32 is kept in the same plane as before and the same plane as the repositioned first satellite pulley 28. This arrangement allows the minutes drive belt 30 to be kept in alignment with the two pulleys 26, 28 and allows the first satellite pulley 28 and part of the minutes drive belt 30 to be hidden from the viewing side by the hours hand 20.

Figure 10A:
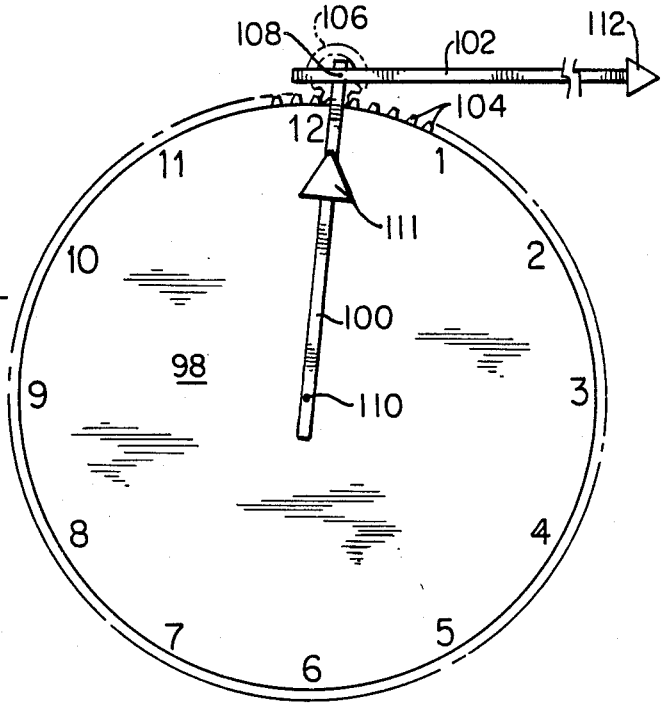
FIG. 10*a* is a front view of another embodiment of the present invention showing a round clock face having a toothed periphery for driving the remotely positioned minutes hand.
Figure 10B:
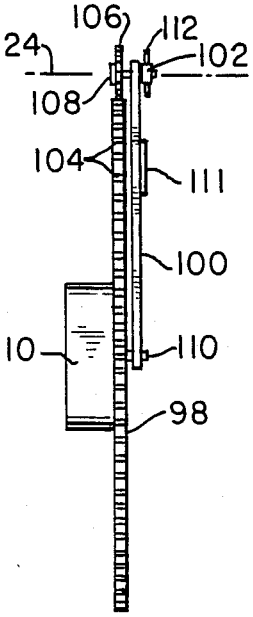
FIG. 10*b* is a side view of FIG. 10*a;*

Another embodiment is shown in FIGS. 10*a* and 10*b*. The clock arrangement in this embodiment includes a circular face 98. The radius of the face 98 is slightly shorter than the distance measured between the central axis 18 and the first satellite axis 24. An hours hand 100 extends from and rotates around the conventional center position of the clock face 98. A minutes hand 102 (like the preferred embodiment) extends from and rotates around the first satellite axis 24. A seconds hand is not shown for reasons of clarity. If a seconds hand is to be used with this clock arrangement along the hours hand or minutes hand, it can be driven by similar means as described in the preferred embodiment above.

The circular clock face 98 includes along its circumference a multitude of gear teeth 104 (the entire clock face 98 can be a large spur gear). A minutes driving spur gear 106 replaces the first satellite pulley 28 of the preferred embodiment as shown in FIG. 2 and discussed above. The spur gear 106 is connected to an axle 108 (axle 108 can be the first satellite axle 32). The axle 108 is free to rotate within a hole located at the first satellite axis position 24 through the hours hand 100. The minutes hand 102 is also attached to the axle 108 so that the spur gear 106, the minutes hand 102 and the axle 108 rotate together around the first satellite axis position 24 along the hours hand 100. The first satellite axis 24 is located so that the teeth of the spur gear 106 engage with the gear teeth 104 of the clock face 98, as shown in FIG. 10*a*. The clocking mechanism used in this embodiment requires only one conventional output shaft, an hours output shaft 110 rotating at an hours rate.

In operation, the hours hand 100 is rotated around the conventional center axis 24 position by the output shaft 110 at the hours rate of rotation. As the hours hand 100 moves (albeit slowly) with respect to the stationary clock face 98, the engaged spur gear 106 is forced to rotate. Rotation of the spur gear 106 causes the attached minutes hand 102 to rotate around the axis 108 in the conventional rotational direction (clock-wise). The size of the spur gear 106 is dependent on the size of the clock face (gear) 98. The measured circumference of the spur gear 106 must be equal to one twelfth the measured circumference of the circular clock face (gear) 98 if the minutes hand is to rotate at a rate of one every hour.

EXAMPLE I

If a clock face has a circumference of 12 inches, then 1 inch lies between each hour indicia (1–12). Since the spur gear 106 must rotate once an hour (if the attached minutes hand 102 is to rotate at the conventional minutes rate), then the spur gear 106 must travel exactly 1 inch every hour. The measured circumference of the spur gear 106, in this example, must be equal to 1 inch. For every inch the hours hand 100 moves along the circumference of the clock face 98, the minutes hand 102 will rotate once. The minutes hand will always keep its "0" or "60" minutes position constant relative to the "12" hour position of the clock face 98.

The conventional analog clocking mechanism rotates all three output shafts (hours, minutes, and seconds) linearly, owing to the common drive means within the clocking mechanism. In other words, at twelve fifteen (12:15), shown in FIG. 10*a*, the pointing end of the hours hand 100 will be located one quarter the distance between the numbers twelve and one on the clock face 98. It is this linear movement of the hours hand 100 which rotates the spur gear 106 along the circumference of the clock face 98. The hours movement is subdivided into minutes by the spur gear 106. The benefit of this clock arrangement shown in FIGS. 10*a* and 10*b* is that the minutes drive means is "hidden" because it functions as the clock face 98 and only an hours output shaft is required to measure time in hours and minutes.

Figure 10C:
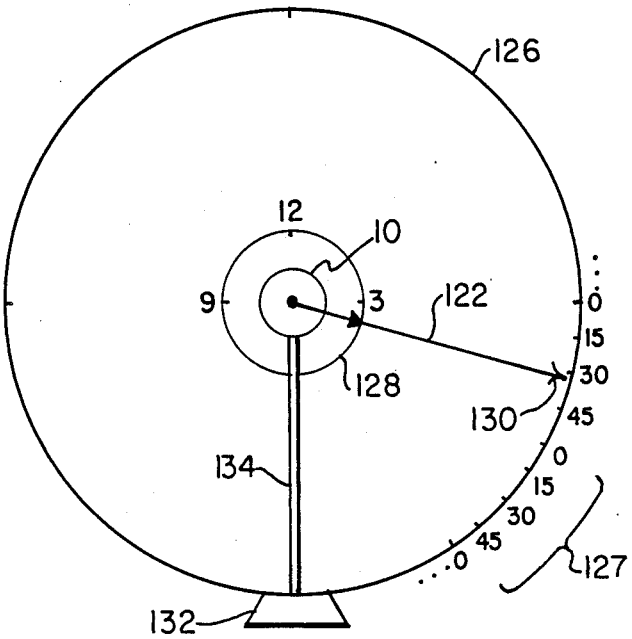
FIG. 10*c* is a front view of another embodiment of the present invention showing a clock having one hand for measuring time in both hours and minutes.
Figure 10D:
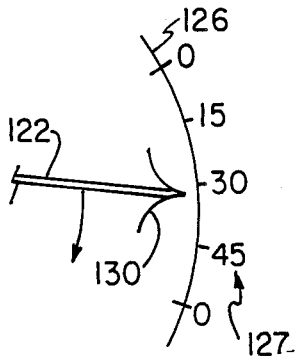
FIG. 10*d* is a partial view of one embodiment of the present invention shown, in FIG. 10*c* showing a minutes scale.

Another embodiment, shown in FIGS. 10*c* and 10*d*, shows a clock arrangement which also only requires an hours output shaft. The clock includes two rings 124 and 126, one accommodating hour indicia and the other (larger) embracing minutes indicia. One clocking hand 122 is used in this clocking arrangement. The hand 122 has two pointing arrows 128 and 130, for indicating measured hours and minutes, respectively. The hand 122 rotates at an hours rate (one revolution/720 minutes). The hours ring 124 has a conventional analog hours indicia arrangement. The distance travelled by the clocking hand 122 along the minutes ring 126 in one hour defines a complete minutes range, from 0 minutes to 59 minutes (totalling 60 minutes). There are twelve separate minutes scales 127 around the outer minutes ring 126, each ranging from 0 to 59 minutes in any functional increment (such as 1 minute or fifteen minutes). FIG. 10*d* shows one such scale 127. At three thirty two (3:32), for example, the hours pointing arrow 128 points just about halfway between the numbers "three" and "four" on the hours ring 124. The minutes pointing arrow 130 points almost halfway along its "three" to "four" O'clock minutes scale at "thirty-two" minutes, as shown in FIG. 10*c*. This clock can be a floor clock (or other) including a base 132. The base 132 supports a clock mechanism pole 134 and the outer minutes ring 126. The pole 134 extends from the base 132 to the center of both concentric rings 124, 126 and supports the clocking mechanism 10 (having or using only the hours output drive shaft), and the clocking hand 122. The inner hours ring 124 is attached to the support pole 134. The preferred indicia used with this clock arrangement is "one" through "twelve" for the hours and "0", "15", "30", and "45" for each of the twelve minutes scales along the minutes ring 126.

What is claimed is:

1. A time measuring device comprising:

a first time indicating member rotatable about a first axis at a first rate; and a second time indicating member rotatable about a second axes at a second rate, said second axes being parallel to said first axes and located at any point on said first member other than the location of said first axes.

2. A time measuring device according to claim 1, wherein said time indicating members are elongated.

3. A time measuring device according to claim 1, further comprising a third time indicating member rotatable about any third axis located on either said first or said second time indicating members.

4. A time measuring device according to claim 2 wherein said elongated first time indicating member rotates about said first point once every twelve hours.

5. A time measuring device according to claim 2 wherein said elongated second time indicating member rotated about said second point once every hour.

6. A time measuring device according to claim 3 wherein said third time indicating member is elongated and rotates about said third point once every minute.

7. A time measuring device comprising:

a clocking mechanism having at least one drive shaft rotatable at a first rate about a first axis;

a first elongated member attached at said first axes to said drive shaft;

a second elongated member rotatably secured to said first elongated member at a second axes, said second axes being parallel to said first axes and located at any point on said first member other than the location of said first axes; and means for rotating said second elongated member about said second axes at a second rate such that measured time is indicated by relative positions of said first and said second elongated members.

8. The device according to claim 7 further comprising a third elongated member rotatably secured to said second elongated member at any second rotating point along said second elongated member and means for rotating said third elongated member at a third rate.

9. The device according to claim 7 wherein said first elongated member is an hours indicating hand, said first rate is one revolution every 12 hours, said second elongated member is a minutes indicating hand and said second rate is one revolution every hour.

10. The device according to claim 8 wherein said third elongated member is a seconds indicating hand and said third rate is one revolution every minute.

11. The device according to claim 9 wherein said drive means includes:

a clocking mechanism having at least a drive shaft rotatable once every hour;

a central pulley connected to said drive shaft;

a satellite axle located along said second axes for supporting said rotatable minutes hand;

a satellite pulley attached to said minutes hand and being rotatably positioned about said satellite axle;

a pulley belt connected to said central pulley and said satellite pulley such that rotation of said drive shaft is transmitted to said satellite pulley which rotates said minutes hand once every hour.

12. The device according to claim 9 wherein said drive means comprises:

a circular clock face having gear teeth disposed along its periphery; and a driving gear attached to said minutes hand, said driving gear being rotatably positioned at said first rotating point such that said driving gear engages with said teeth of said clock face and rotation of said hours hand forces said driving gear to rotate along said periphery, thereby rotating said minutes hand once every hour.

13. The device according to claim 9 further comprising an hours reference ring centrally located about the drive shaft of the clocking mechanism for supporting indicia, said indicia indicating magnitude of displaced time measured in hours.

14. The device according to claim 13 further comprising:

a minutes reference ring centrally located about said first rotating point for supporting minutes indicia, said minutes indicia used to indicate magnitude of displaced time measured in minutes, said minutes reference ring rotatable about said first rotating point;

a weight attached to said minutes reference ring so that as said hours hand rotates around said drive shaft, said minutes reference ring keeps said minutes indicia in a constant position with respect to said hours indicia.

15. The device according to claim 7 wherein said second elongated member is a seconds indicating hand and said second rate is one revolution every minute.

16. The device according to claim 15 wherein said first elongated member is an hours indicating hand and said first rate is one revolution every twelve hours.

17. The device according to claim 15 wherein said first elongated member is a minutes indicating hand and said first rate is one revolution every hour.

* * * * *